United States Patent [19]

Fujishima et al.

[11] 4,370,544

[45] Jan. 25, 1983

[54] HAIR DRYER

[75] Inventors: Mobuiti Fujishima, Hikone; Hideharu Nakano, Omihachiman; Yukio Wada, Hikone, all of Japan

[73] Assignee: Matsushita Electric Works, Ltd., Osaka, Japan

[21] Appl. No.: 215,840

[22] Filed: Dec. 12, 1980

[30] Foreign Application Priority Data

May 15, 1980 [JP] Japan ..... 55-65505

[51] Int. Cl.[3] ..... H05B 1/00; A45D 20/12; F04B 35/04

[52] U.S. Cl. ..... 219/370; 34/96; 200/50 B; 219/374

[58] Field of Search ..... 34/96, 97; 200/50 B, 200/50 R; 219/369, 370, 373, 374, 363, 364

[56] References Cited

U.S. PATENT DOCUMENTS 3,348,020 10/1967 Cooper ..... 219/374 X
3,953,710 4/1976 Dyer ..... 34/96

*Primary Examiner*—Roy N. Enuall, Jr.
*Attorney, Agent, or Firm*—Burns, Doane, Swecker & Mathis

[57] ABSTRACT

Flat and compact hair dryer of a type having a housing and an electric cord which can be wound in an outer peripheral groove of the housing. The cord is connected to a switch by means of a bushing rotatably pivoted within the housing so that the inner end of the bushing prevents the switch from moving to its ON-position from an OFF-position when the cord is wound around the housing. When the switch is in the ON-position, the bushing is prevented from rotating to a retracted position, thereby providing an indication that the switch is on.

9 Claims, 8 Drawing Figures

HAIR DRYER

This invention relates to hair dryers and, more particularly, to a hair dryer of a compact structure adapted to be carried.

Conventionally, the hair dryers in general have been of such a configuration typically as shown in FIG. 8, as has been suggested for example in U.S. Pat. No. 3,889,693, wherein a cylindrical or disk-shaped main body MB containing an air blowing means comprises a motor and a fan. The body is formed to have two projections so as to be substantially in an L-shape, one of which is a gripping part G containing a switch to which a cord C entering the part G is connected. A switch operating button SB is exposed out of the part G. The other projection of the body is a duct part D for blowing out an air stream from the blowing means through an electric heating means. In this case, the entire configuration is not compact and, in addition, the cord must be bundled into a loop shape when the dryer is not used so as to render the shape for its storage also not compact but rather bulky, has been inconvenient. Further, in an event when the cord is wound on the main body and duct part, the switch operating button has no means for locking the same at its OFF position so that there will be a risk that the switch is accidentally turned ON and the cord is damaged by hot air blown out. On the other hand, there has been suggested a hair dryer of a compact shape provided with an outer peripheral groove or channel for receiving the cord wound in such groove when the dryer is not used. However, in this case, too, there is provided no measure for preventing any accidental operation of the switch while the cord is wound and, besides, there are such defects that the wound cord easily escapes out of the groove. Also, no consideration is made for rendering the user's gripping or holding of the dryer to be easy and stable in the state where the cord is unwound. The present invention has been suggested to remove these defects of such conventional hair dryers as above.

A primary object of the present invention is, therefore, to provide a hair dryer of a compact structure which allows the electric cord to be easily bundled for storage and carrying.

Another object of the present invention is to provide a hair dryer having a cord winding means high in the housing to retract the cord when the dryer is not used and yet the entire structure is easy and stable to grip during use.

Still another object of the present invention is to provide a hair dryer which is compact and yet safe as any accidental operation of switch means is prevented by the winding of the cord on the dryer.

Another object of the present invention is to provide a compact hair dryer having a safe structure adapted to prevent any accidental switch operation by the winding of the cord on th dryer, wherein electric connection between the cord and the switch is simplified.

Other objects and advantages of the present invention shall be made clear as explanations of the invention advances in the followings is detailed with reference to a preferred embodiment of the invention shown in accompanying drawings, in which.

Figure 1:
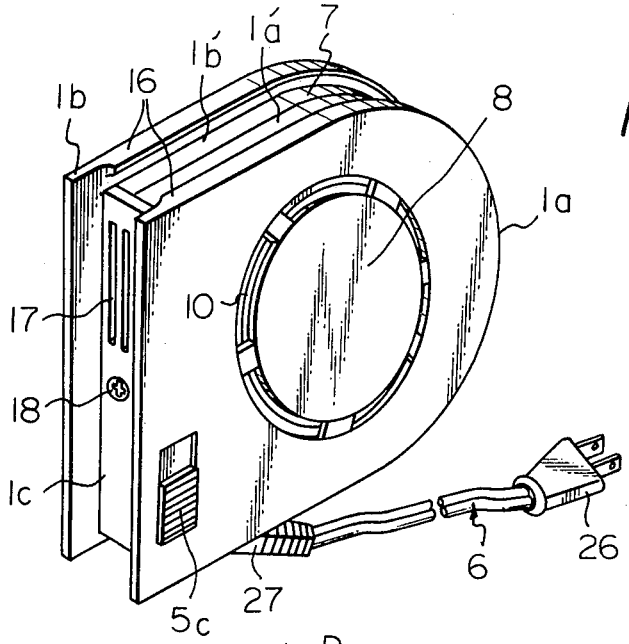
FIG. 1 is a perspective view of a hair dryer according to the present invention.
Figure 8:
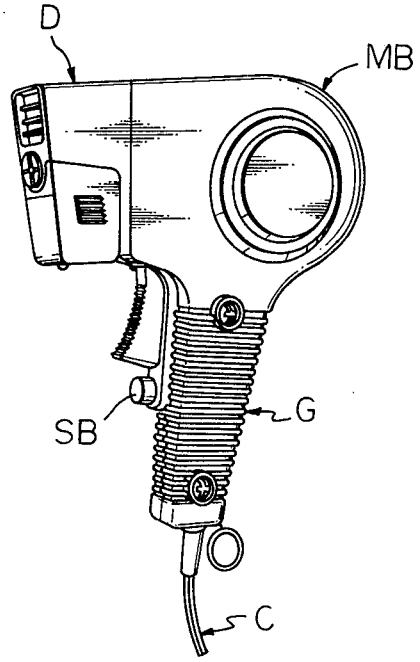
FIG. 8 is a perspective view of a conventional hair dryer.

While the present invention shall be explained in the following with reference to the illustrated embodiment, the intention is not to limit the invention to the particular embodiment shown but rather to include all alterations, modifications and equivalent arrangements possible within the scope of appended claims.

The structure of the hair dryer embodying the present invention shall be described with reference to FIGS. 1 to 6. In the contour, this hair dryer has a flat shaped body convenient to carry. In this case, the flat body has a substantially U-shaped contour and comprises generally a housing 1 forming the body, an air blowing means comprising a fan 2 and motor 3 housed in the housing 1, a heating means 4 comprising an electric resistor, a switch 5 opening and closing an electric circuit to both the blowing and heating means and an electric source current cord 6 connected to this switch.

The housing 1 is formed by fitting together in parallel two split side wall plates 1*a* and 1*b* of substantially the same shape. In such case, peripheral wall members 1*a*′ and 1*b*′ are formed on the respective side wall plates 1*a*, 1*b* along a line parallel to and offset inwardly from the outer peripheral edge, which wall members 1*a*′ , 1*b*′ form an outer peripheral groove 7. Both side wall plates 1*a*, 1*b* have a circular embossment 8 and 9 in the parts opposed to each other in the center of the arcuate part of the U-shape. An annular air intake port 10 is provided along the peripheral edge of the respective circular embossments 8 and 9. A cylindrical motor-receiving part 11 of a relatively small diameter is disposed in the internal space of the housing and is integrally formed on the inner surface of the embossment 9 of the side wall plate 1*b*. The mutually fitted side wall plates 1*a* and 1*b* are coupled by means of a metal plate 12 substantially of a U-shaped cross-section and having a resiliency. A pair of projections 13 are provided in the part corresponding to the bottom surface of the U-shaped plate 12 as cut and raised and, in the present instance, these projections 13 are inserted into a pair of slits 14 provided in the corresponding positions of the arcuate part of the peripheral walls 1*a*′ and 1*b*′. Both end leg parts 15 of the plate 12 are resiliently engaged with the inside surfaces of flanges 16 slightly projecting into the outer peripheral groove 7 along the outer peripheral edges of the side wall plates, so as to firmly couple the both side wall plates. The provision of the flanges 16 renders the outer peripheral edges of the housing 1 to be slightly broadened, whereby the cord 6 wound in the groove 7 is prevented from easily escaping out of the groove and also the housing 1 can be made easy to grip by fingers of the user. On the other hand, the straight part of the peripheral walls 1a' and 1b' opposed to the arcuate part to which the fixing plate 12 is fitted is formed substantially of an L-shape member 1c having in the long leg side end part an air blowing port 17 through which the internal space defined by the peripheral walls 1a' and 1b' is made to communicate with the exterior. The end of the long leg is formed as an engaging part 17a which engages and holds the end edges of the respective peripheral walls 1a' and 1b'. This L-shaped peripheral wall member 1c is fixed to the housing by a screw 18 passed through the member 1c substantially in its middle position and into a nut 17b contained in a nut receiver provided in both side wall plates 1a and 1b, so as to couple the both side wall plates to each other. In this embodiment, the air blowing port 17 is provided eccentrically on one side of an imaginary axial line passing through the center of the arcuate part of the U-shaped housing. An end of the arcuate part on that same eccentric side of the peripheral walls 1a' and 1b' is extended straight toward the engaging part 17a of the member 1c but the other side end of the arcuate part continues to be an arc to reach substantially the axial line so as to form substantially a J-shape. The shorter leg side end part of the L-shaped straight member 1c terminates to define an opening 7a between the end part and an arcuate part of the J-shaped peripheral wall so as to communicate the internal space of the housing on its side opposite to the air blowing port 17 with respect to afore-mentioned imaginary axial line with the exterior through the outer peripheral groove 7.

Figure 2:
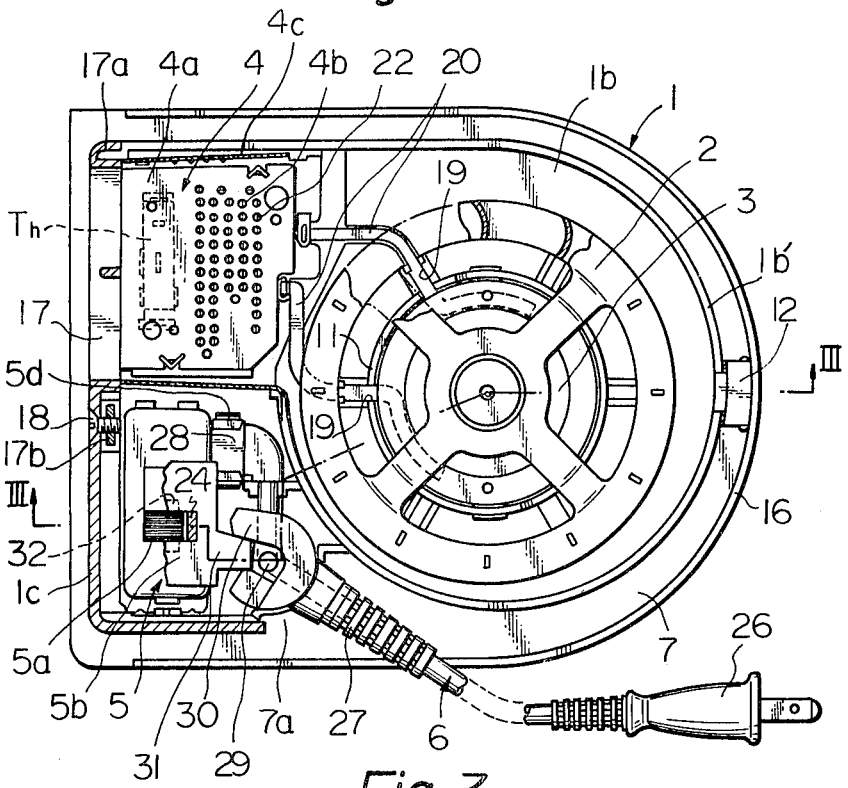
FIG. 2 is a plan view of the hair dryer shown in FIG. 1 with one side wall plate of the housing removed and some parts in section.
Figure 3:
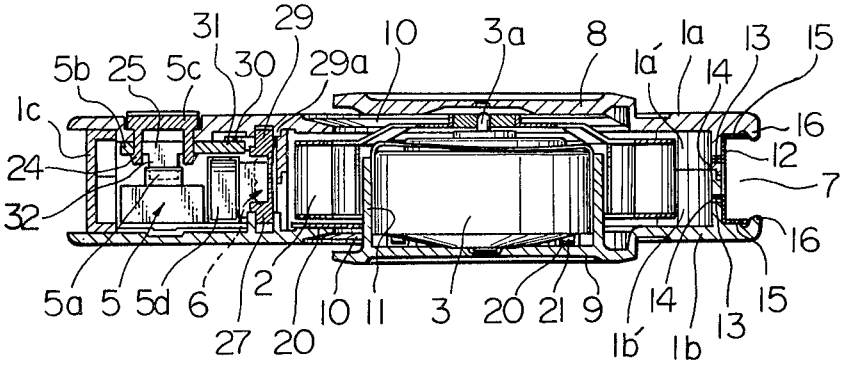
FIG. 3 is a cross-sectional view as seen on line III—III in FIG. 2.

In the peripheral body of the motor-receiving part 11 on one side wall plate 1b of the housing, as seen in FIG. 2, two channels 19 are provided. A pair of conducting lead plates 20 extend from a printed wiring base plate 4a of the heating means 4 fitted to the inner surface of the side wall plate 1b inside the air blowing port 17. Those plates 20 are arranged along the inner surface of the side wall plate and extend to opposing positions in the diametral direction of the circular embossment 9 in the motor-receiving part 11 through the respective channels 19. The respective lead plates 20 are made resilient at the tips as separated from the inner surface. The motor 3 has two terminals 21 opposed to each other in the diametral direction on the side facing the bottom of the motor-receiving part 11. These terminals 21 of the motor are resiliently connected respectively to the tips of the lead plates 20 as seen in FIG. 3 in the positions in which they are inserted and fixed within the receiving part 11 by a proper resilient fitting means. For the fan 2 of the blowing means, a so-called sirocco fan is used in the present instance, and this fan is fitted at its center to a rotary shaft 3a of the motor so that the fan 2 will be disposed around the motor-receiving part 11 and the fan 2 will be surrounded by the arcuate part of the peripheral walls 1a' and 1b'.

The heating means 4 comprises a thin heater wire 22 reciprocally reversing back and forth between a pair of base plates 4a through many small holes 4b made in the plates. The wire 22 is disposed in an air stream path between the fan 2 and the air blowing port 17 so that an air stream generated by the rotation of the fan 2 will pass the thus arranged heater wire 22. When an electric current is passed through the wire, the air stream will be heated by the heat generated in the wire 22 and blown out of the port 17 as a hot air stream. When no electric current is passed through the heater wire 22, the air stream will be blown as a cold air flow. A substantially U-shaped metal cover 4c is fitted to the base plates 4a. A leg of that cover, shown in section below the heater wire 22 in FIG. 2 extends between the terminating edge of the arcuate part of the peripheral wall and the straight peripheral wall member 1c and defines the air flow path, but the arcuate part of the peripheral wall may be extended, instead, so as to replace the leg part of the cover. It is preferable to define the air stream path with a heater cover of a heatproof metal plate.

Figure 4:
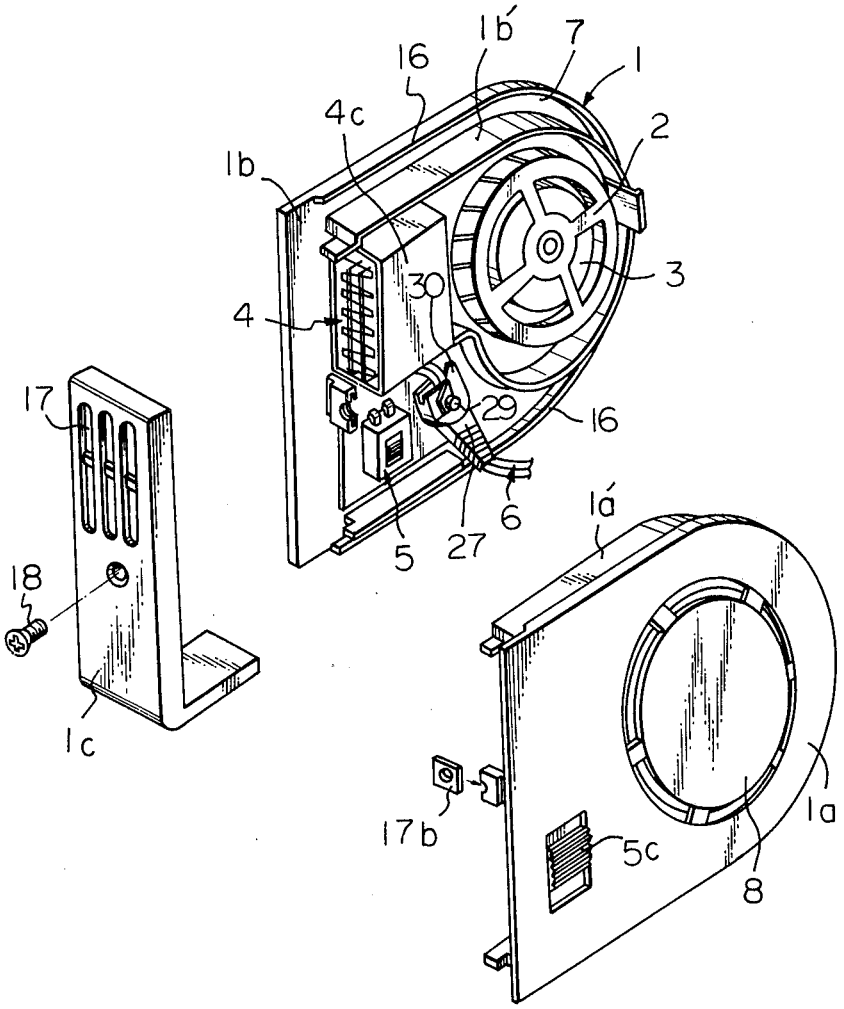
FIG. 4 is a perspective view of the hair dryer of FIG. 1 in a state where housing components are disassembled.
Figure 5:
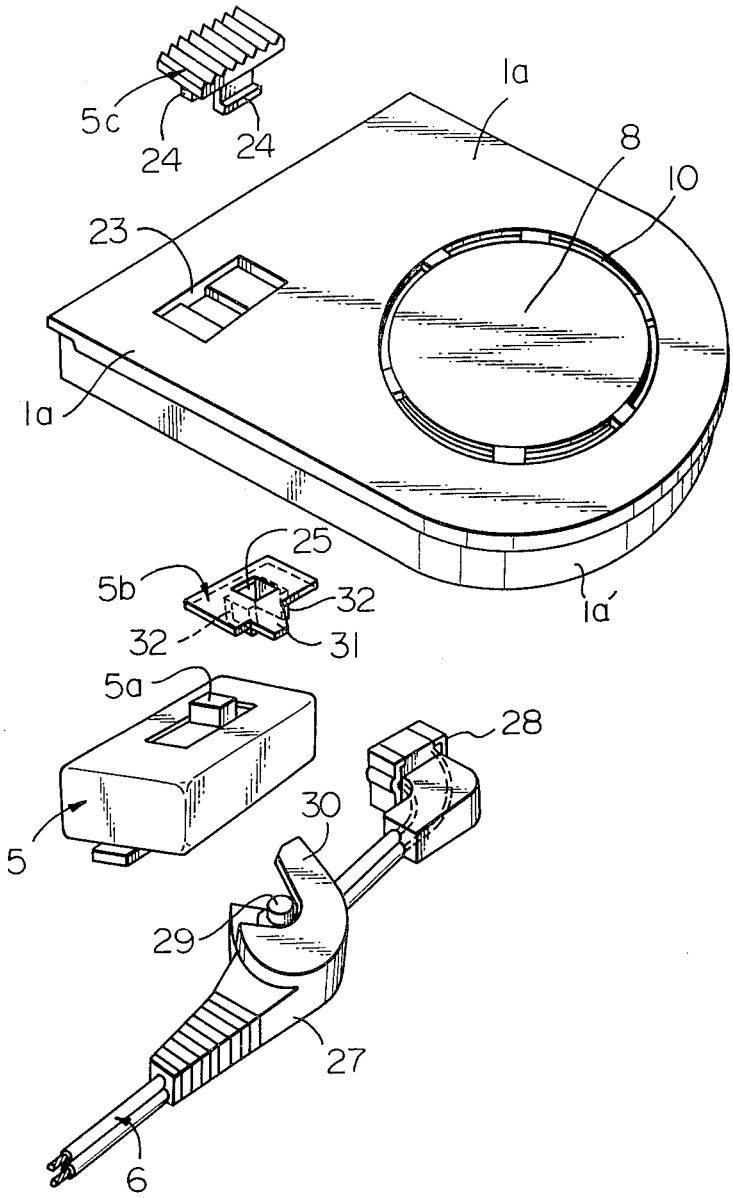
FIG. 5 is a perspective view as disassembled of a switch, connector of a cord, bushing, switch operating knob, linking means and one side wall plate of a housing to which the knob is fitted in the hair dryer of FIG. 1.

A sliding type switch 5 is provided in the present case for opening and closing a circuit feeding an electric current to both of the heater wire 22 and motor 3 or only to the motor 3 through the wiring of the printed base plate 4a. The switch 5 is fixed to the side wall plate 1b of the housing within a space defined by the air stream path, straight wall member 1c and arcuate part of the peripheral wall. An operating lever 5a of the switch is directed toward the other side wall plate 1a so as to be manually operated from the exterior of the housing through an operating knob 5c mounted slidably through a corresponding part of the side wall plate 1a. As seen in FIGS. 3 and 4, the operating knob 5c is coupled to a switch cam 5b positioned on the inside surface of the side wall plate 1a. A pair of hooks 24 of the operating knob 5c, extending into the housing through a hole 23 made in the side plate 1a, engage with the other surface of the cam 5b through a hole 25 in the cam 5b. A pair of legs 32 provided on the other surface of the cam 5b hold the operating lever 5a on its both front and rear sides in the sliding direction of the lever 5a of the switch 5. Thus the lever 5a of the switch is operated by the operating knob 5c slidably mounted to the side wall plate 1a.

The electric cord 6, having a plug 26 connected to an extended end, has a pair of conducting wires one connected to the switch 5 and the other connected to the heating and air blowing means. As a preferable arrangement, the cord 6 is first passed through the body of a substantially hollow tubular and flexible bushing 27 and is coupled with a connector 28 holding a pair of connecting terminals exposed in the opposite directions. The cord wires are connected to those terminals as embedded integrally in a molding of an insulative synthetic resin with the terminals. The current source side terminals of the switch 5 are connected to a pair of current feeding plates 5d extending from the side wall plate 1b toward the other side wall plate 1a in the base plate 4a. The connecting terminals of the connector 28 thus coupled with the cord 6 are resiliently inserted between these current feeding plates 5d so as to perform the electric connection.

The bushing 27 is arranged to pass through the opening 7a of the peripheral groove 7 of the housing. A pivot shaft 29 projects out of the bushing 27 toward both inner surfaces of the side wall plates 1a and 1b at the end part on the side of the connector 28. The shaft 29 is carried by a bearing 29a provided at a corresponding position of the inner surface of the side wall plate so as to fit the bushing of the cord rotatably about the shaft 29. The bushing 27 is further provided with a stopper arm 30 projecting inward the housing from the pivot side end surface. On the other hand, the switch cam 5b of the operating knob 5c engaging the switch operating lever 5a has an arm 31 extending toward the pivoting end of the bushing substantially at right angles with respect to the moving directions between both ON and OFF positions of the lever 5*a*. When the bushing 27 is rotated to a rest position where the body of the bushing 27 with the cord is laid against the arcuate part of the peripheral wall of the housing in the OFF position of the switch operating lever 5*a*, the stopper arm 30 of the bushing will abut on its extended side surface against a side surface on the ON position side of the arm 31 of the switch cam 5*b* to lock the same. Rotation of the bushing 27 itself when the cord 6 is wound on the housing 1 in the outer peripheral groove 7 is prevented. Thus the switch cam 5*b* and switch operating lever 5*a* are also prevented from moving toward the ON position by the stopper arm 30 of the bushing 27.

Figure 7:
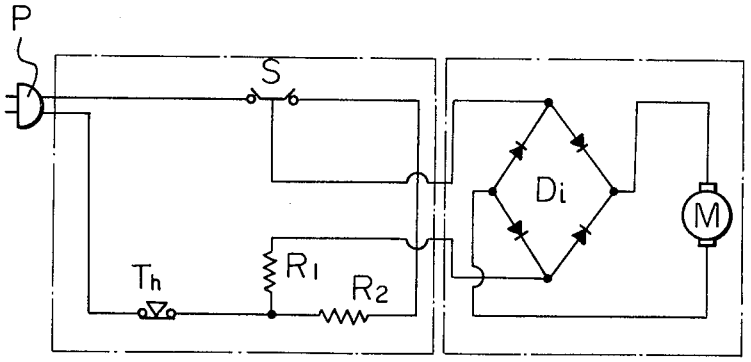
FIG. 7 is an electric circuit diagram of the hair dryer of FIG. 1.

The electric circuit of this hair dryer is shown in FIG. 7, in which "P" denotes the plug 26 of the cord 6. "S" denotes the switch 5 of a type of three step operations of "OFF" position, "COLD" position in which an electric current is fed only to the motor 3 to blow cold wind and "HOT" position in which the current is fed to the motor 3 and heater 4 to blow hot wind; "Th" denotes a temperature controlling thermoswitch connected between the heater 4 and the switch 5; "Di" denotes a rectifier inserted between the motor 3 and the switch 5; "M" denotes the motor 3; "$R_1$" denotes a voltage dividing resistor and "$R_2$" denotes the heater 4.

Figure 6:
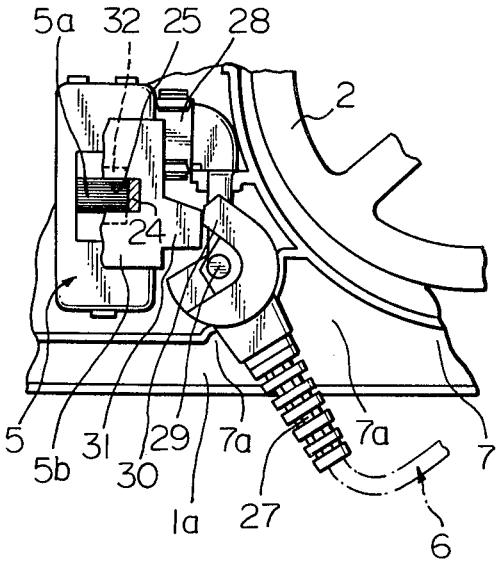
FIG. 6 is a fragmental plan view showing a relation of an erected position of the bushing and an ON-position of the switch and linking means engaging with the bushing in an embodiment of the hair dryer shown in FIG. 1.

Referring now to the operation of the hair dryer of this embodiment, the cord 6 wound in the outer peripheral groove 7 of the housing 1 is first all unwound to render the bushing 27 rotatable and the plug 26 is connected to a current source. When the user slides the switch operating knob 5*c* to the "ON" position ("COLD" or "HOT" position) of the switch, the bushing 27 and its stopper arm 30 will be pushed and rotated by the arm 31 of the switch cam 5*b*, and the state of FIG. 6 showing the switch and bushing in one ON position corresponding to the "COLD" position will be attained. Here, it will be appreciated that, so long as the bushing 27 is not biased by any resilient means toward the rest position, the unwinding of the cord 6 will allow or cause the bushing 27 to be rotated to have its arm 30 disengaged from the switch cam arm 31 and the switch cam 5*b* becomes slidable. In this rotated state, the stopper arm 30 of the bushing 27 contacts at the tip with the tip surface of the arm 31 of the switch cam 5*b* and the bushing 27 separates from the arcuate part of the peripheral wall of the housing 1 so as to be in an erected position transversing the outer peripheral groove 7. Therefore, the bushing 27 will be prevented by the switch cam arm 31 from rotating back to the rest position from this erected position. The tip surface of the arm 31 of the switch cam 5*b* has a length sufficient for contacting the tip of the stopper arm 30 of the bushing even when the switch cam 5*b* and switch operating lever 5*a* are further moved to the "HOT" position so that, in whichever ON position the switch is, the bushing 27 will be held in the erected position. In the ON state of the switch, therefore, the cord 6 will not be wound directly close to the peripheral wall of the housing 1 since, even if the cord is attempted to be wound in error, it will project out of the outer peripheral groove 7 together with the bushing 27 and the user can easily notice that it is wrong to wound the cord in this state. In order to render this more positive, it is preferable to have the bushing 27 provided with a length sufficient to project out of the peripheral edge of the housing 1 from the outer peripheral groove 7 in the erected position.

Now, when the switch operating knob 5*c* is pushed toward the OFF position after the dryer is used, the arm 31 of the switch cam 5*b* will separate from or slide along the tip of the stopper arm 30 of the bushing 27 which has been in engagement with the tip of the arm 31 and the switch cam 5*b* and operating lever 5*a* will be moved to the OFF position shown in FIG. 2. In this connection, it is preferable that the parts other than the stopper arm 30 of the pivoting end of the bushing 27 are so formed as not to contact the arm 31 of the cam. When the switch 5 is thus brought into the OFF position, the stopper arm 30 is released from engagement with the tip of the arm 31 of the switch cam 5*b*. Thus, the stopper arm 30 of the bushing 27 is allowed to come into the ON direction side of the cam arm 31, whereby the bushing 27 is made rotatable in the direction of lying against the arcuate part of the peripheral wall of the housing 1. Thus, in the OFF position of the switch, the bushing 27 can be rotated to its rest position, the cord 6 can be smoothly directly wound on the peripheral wall within the outer peripheral groove 7 of the housing, the stopper arm 30 of the bushing 27 and the arm 31 of the switch cam 5*b* will be engaged with each other at their side edges as shown in FIG. 2 and the ON operation of the switch in this state will be made impossible.

The illustrated relation of the disposition of the switch 5 specifically in respect of the moving directions between the both ON and OFF positions of the switch operating lever 5*a* to the dispositions of the pivot shaft 29 and stopper arm 30 of the bushing 27 is most advantageous in achieving (i) effective utilization of the internal space of the housing, (ii) compactness of the entire dryer and smooth winding of the cord. However, those parts can be combined with each other in any other relation, and the switch itself is not limited to be of the illustrated sliding operation type. In any case, the switch and bushing are arranged close to each other and the means for linking the ON and OFF operations of the switch with the rotation of the bushing is made so as to allow the bushing to be rotated to the rest position only when the switch is in the OFF position and to keep the bushing in the erected position when the switch is in the ON position. For this purpose, it is necessary to attain the relation between the stopper arm 30 of the bushing 27 and the switch operating lever 5*a* in which the stopper arm 30 of the bushing in the rest position prevents the switch operating lever 5*a* in its OFF position from moving toward the ON position.

According to the present invention, the compact hair dryer in which the cord can be wound on the periphery of the body as has been described in the foregoings, is advantageous in that, when the cord is wound in the outer peripheral groove of the housing, the switch will not be able to be made ON. Also, when the switch is in the ON state, the cord will not be able to be smoothly wound in the outer peripheral groove and the damage of the cord by any mis-operation of the switch and short-circuiting accident due to such damage can be effectively prevented. Further, since the switch, the bushing of the electric cord, electric connecting means between the switch and the cord, and the operation linking means between the switch and the bushing are effectively arranged within a space other than that occupied by the air blowing means and air stream heating means, the compactness of the dryer of the kind referred to is not diminished. The electric connecting means and operation linking means can attain the respectively required connecting and linking relations in the pivot mounting direction of the bushing, so that they can be easily assembled and an economical manufacture can be well maintained. As the current feeding connection of the motor can be simultaneously attained during the motor fitting operation, no soldering operation is required for the assembly, the thickness of the dryer can be decreased by the amount corresponding to the space required for soldering and thickness of the lead wire, and the dryer compactness can be well improved.

What is claimed is:

1. A hair dryer comprising:

a housing including a pair of side walls and a recessed peripheral groove formed between said side walls, electrically actuated air blowing means disposed in said housing and arranged to blow air through an air discharge port of said housing, electrical actuated heating means in said housing for heating said air prior to discharge, a manually movable switch assembly disposed in said housing, an electrical cord operably connectible to said blowing and heating means through said switch assembly which is manually movable between ON- and OFF-positions, said cord including an exposed portion windable around said housing within said peripheral groove, and a bushing movably disposed in said housing and connected to said cord, said bushing being movable between a first position in response to said cord being wound in said groove and with said switch assembly in said OFF-position, and a second position when said cord is unwound, said switch assembly and said bushing including mutually cooperative surfaces arranged for mutual engagement when said bushing is in said first position and said switch assembly is in said OFF-position, to prevent said switch assembly from being moved to the ON-position, said surfaces being arranged to mutually disengage when said bushing is moved to said second position in response to unwinding of said cord, to enable said switch assembly to be moved to the ON-position.

2. A hair dryer according to claim 1, wherein said bushing includes a projection carrying a first of said cooperative surfaces and said switch assembly includes an arm carrying a second of said cooperative surfaces, said arm being arranged to prevent movement of said bushing from said second position to said first position when said switch assembly is in said ON-position.

3. A hair dryer according to claim 1, wherein said housing includes an arcuately profiled rear section and a straight front section; said air discharge port, said heating means, said switch assembly, and said bushing being arranged in said rear section; and a peripheral wall member extending between said side walls and into the space between said blowing means and said bushing, said bushing laying against said peripheral wall when in said first position.

4. A hair dryer according to claim 3, wherein said peripheral wall member has an arcuately profiled rear section and a straight front section generally corresponding to the respective portions of said housing, said air discharge port being formed in said front section of said peripheral wall member, said peripheral wall member forming an opening through which said bushing extends.

5. A hair dryer according to claim 1, wherein said side walls each include a flange forming an outer edge thereof, said flanges overlying said peripheral groove.

6. A hair dryer according to claim 1, wherein said bushing is of sufficient length to project beyond the peripheries of said side walls when said bushing is in said second position.

7. A hair dryer according to claim 1, wherein said switch assembly includes a slidable contact-carrying portion and an exposed actuator operably connected therewith, said cooperative surface of said switch assembly being formed on a first arm connected for movement with said actuator.

8. A hair dryer according to claim 7, wherein said cooperative surface of said bushing is formed on a second arm of said bushing, said first and second arms extending generally perpendicular to the direction of travel of said contact-carrying portion when said switch assembly is in the OFF-position and said bushing is in said first position, said second arm disposed at less than a right angle relative to said direction of travel when said bushing is in said second position.

9. A hair dryer according to claim 1, wherein said bushing is mounted for rotation about an axis extending perpendicular to said side walls, said switch assembly comprises electrical first terminals connected to a pair of electrically conductive resilient plates mounted in opposing relation on one of said side walls, said cord including a pair of wires connected to a pair of second terminals carried by an insulative connector, said connector disposed between said resilient conductive plates to engage said second terminals with said resilient plates.

* * * * *